US006796276B2

(12) United States Patent
Kim

(10) Patent No.: US 6,796,276 B2
(45) Date of Patent: Sep. 28, 2004

(54) LINE CONTROL ARRANGEMENT FOR CONTINUOUSLY VARIABLE VALVE TIMING SYSTEM

(75) Inventor: Dae-Woon Kim, Kyungki-do (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 10/322,163

(22) Filed: Dec. 17, 2002

(65) Prior Publication Data

US 2003/0111033 A1 Jun. 19, 2003

(30) Foreign Application Priority Data

Dec. 18, 2001 (KR) ..... 2001-80504

(51) Int. Cl.[7] ..... F01L 1/34

(52) U.S. Cl. ..... 123/90.17; 123/90.15; 123/90.31

(58) Field of Search ..... 123/90.17, 90.15, 123/90.31

(56) References Cited

U.S. PATENT DOCUMENTS 3,774,634 A * 11/1973 Bonney ..... 137/596

5,924,395 A * 7/1999 Moriya et al. ..... 123/90.15

FOREIGN PATENT DOCUMENTS

DE 19637174 3/1997

* cited by examiner

*Primary Examiner*—Thomas Denion
*Assistant Examiner*—Zelalem Eshete
(74) *Attorney, Agent, or Firm*—Morgan Lewis & Bockius LLP

(57) ABSTRACT

The line control arrangement includes a valve timing controller generating a predetermined valve timing variable control signal according to an engine speed of a vehicle; and an oil controlling driver generating a rotational force in a predetermined direction according to the valve timing variable control signal received from the valve timing controller to form a corresponding advance line and a corresponding retard line. The line control arrangement for a continuously variable valve timing system reduces noise generated by operation of an oil controlling driver.

12 Claims, 6 Drawing Sheets

LINE CONTROL ARRANGEMENT FOR CONTINUOUSLY VARIABLE VALVE TIMING SYSTEM

FIELD OF THE INVENTION

The present invention relates to a variable valve timing system, and more particularly, to a line control arrangement for a continuously variable valve timing system.

BACKGROUND OF THE INVENTION

One way in which engine performance can be improved is by opening and closing engine valves differently at low speeds and high speeds. In particular, varying the timing of the intake valves plays a significant role in air induction capability. Accordingly, by opening the intake valves early, a valve overlap interval is increased such that the inertial flow of intake and exhaust processes can be sufficiently utilized at high speeds to result in an increase in volumetric efficiency. However, at low speeds, this results in a decrease in volumetric efficiency and an increase in the exhaust of hydrocarbons from excess, unburned fuel.

To solve this problem, various configurations and methods have been developed that vary the timing of opening and closing of the intake and exhaust valves. One of the most recent developments is the continuously variable valve timing (CVVT) system. A significant drawback of such CVVT systems is that they generate undesirable impact sounds each time the valve timing system is adjusted. Accordingly, a CCVT system that reduces operating noise would be highly desirable.

SUMMARY OF THE INVENTION

The present invention provides a line control arrangements for continuously variable valve timing systems that reduce impact noise generated by operation of an oil controlling driver. In a preferred embodiment, the present invention comprises a valve timing controller generating a predetermined valve timing variable control signal according to an engine speed of a vehicle; and an oil controlling driver generating a rotational force in a predetermined direction according to the valve timing variable control signal received from the valve timing controller to form a corresponding advance line and a corresponding retard line.

According to an embodiment of the invention there is provided a line control arrangement for a continuously variable valve timing system of a vehicle. The line control arrangement includes a housing, and oil supply, a motor, an advance passageway, and a retard passageway. The oil supply shaft is rotatably mounted within the housing. The motor is configured to rotate the oil supply shaft to an advance position or a retard position based on a predetermined valve timing variable control signal received from a valve timing controller. The advance passageway is formed through the housing when the oil supply shaft is in the advance position, the advance passageway fluidly coupling an oil supply hole to an advance hole. The retard passageway is formed through the housing when the oil supply shaft is in the retard position, the retard passageway fluidly coupling an oil supply hole and a retard hole. The supply hole is configured to be fluidly coupled to an oil supply; the retard hole is configured to be coupled to a retard chamber in a vane housing; and the advance hole is configured to be coupled to an advance chamber in a vane housing. An advance drain channel is formed when the oil supply shaft is in the retard position, the advanced drain channel fluidly coupling the retard hole to an exhaust hole. A retard drain channel formed when the oil supply shaft is in the advance position, the retard drain channel fluidly coupling the advance hole to an exhaust hole. The advance passageway comprises a passageway defined by an advance body section coupled to the oil supply shaft, and the housing. The retard passageway comprises a passageway defined by a retard body section coupled to the oil supply shaft, and the housing.

Further according to the invention there is provided a method for controlling a continuously variable valve timing system of a vehicle. When a high engine speed is measured, a predetermined valve timing control signal generated. This signal is then transmitted to a motor coupled to an oil supply shaft. The motor rotates the oil supply shaft to an advance position to form an advance passageway coupling an oil supply hole to an advance hole. This allows fluid to flow through the advance passageway into an advance chamber of a vane housing, thereby moving a vane within the vane housing to alter valve timing. Later, when a lower speed is measured, another valve timing control signal is generated and transmitted to a motor coupled to the oil supply shaft. The oil supply shaft is then rotated to a retard position to form a retard passageway coupling an oil supply hole to a retard hole. This allows fluid to flow through the retard passageway into a retard chamber of the vane housing, thereby moving the vane within the vane housing to alter valve timing.

BRIEF DESCRIPTION OF THE DRAWINGS

The accompanying drawings, which are incorporated in and constitute a part of the specification, illustrate an embodiment of the invention, and, together with the description, serve to explain the principles of the invention.

Preferred embodiments of the present invention will now be described in detail with reference to the accompanying drawings.

DETAILED DESCRIPTION OF THE PREFERRED EMBODIMENTS

Figure 1A:
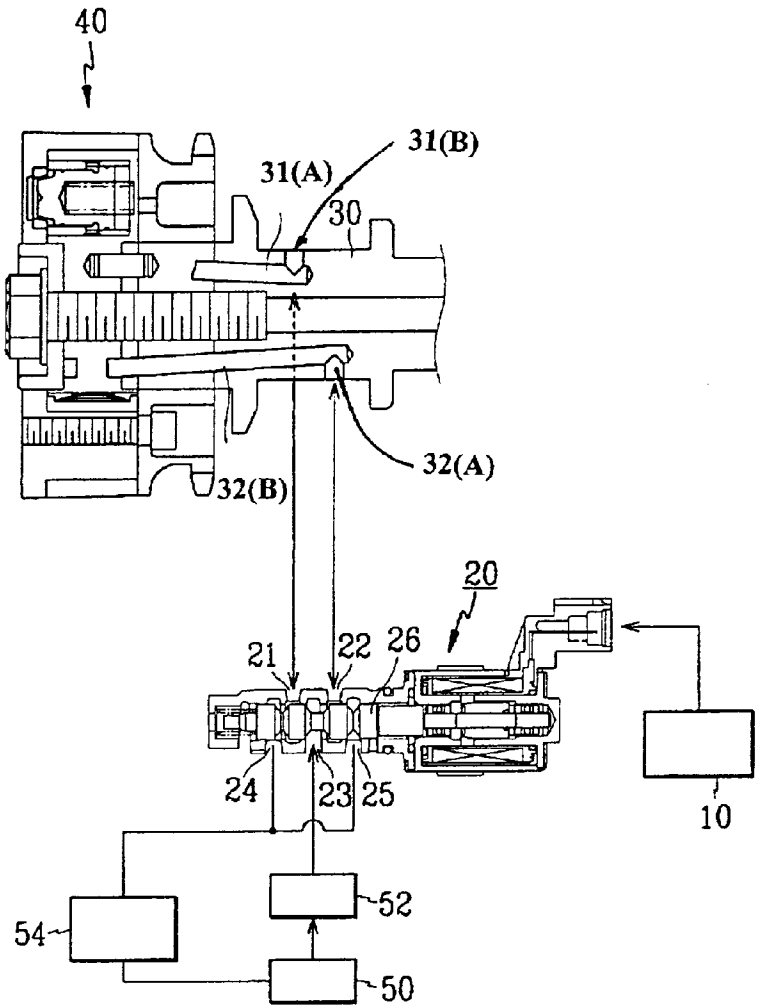
FIG. 1A is a schematic view showing a continuously variable valve timing system.
Figure 1B:
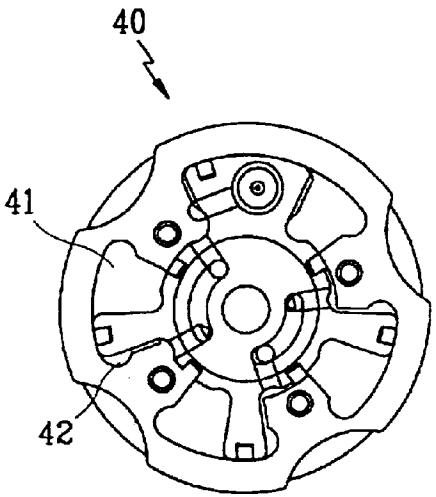
FIG. 1B is an end view of the housing shown in FIG. 1B.
Figure 2:
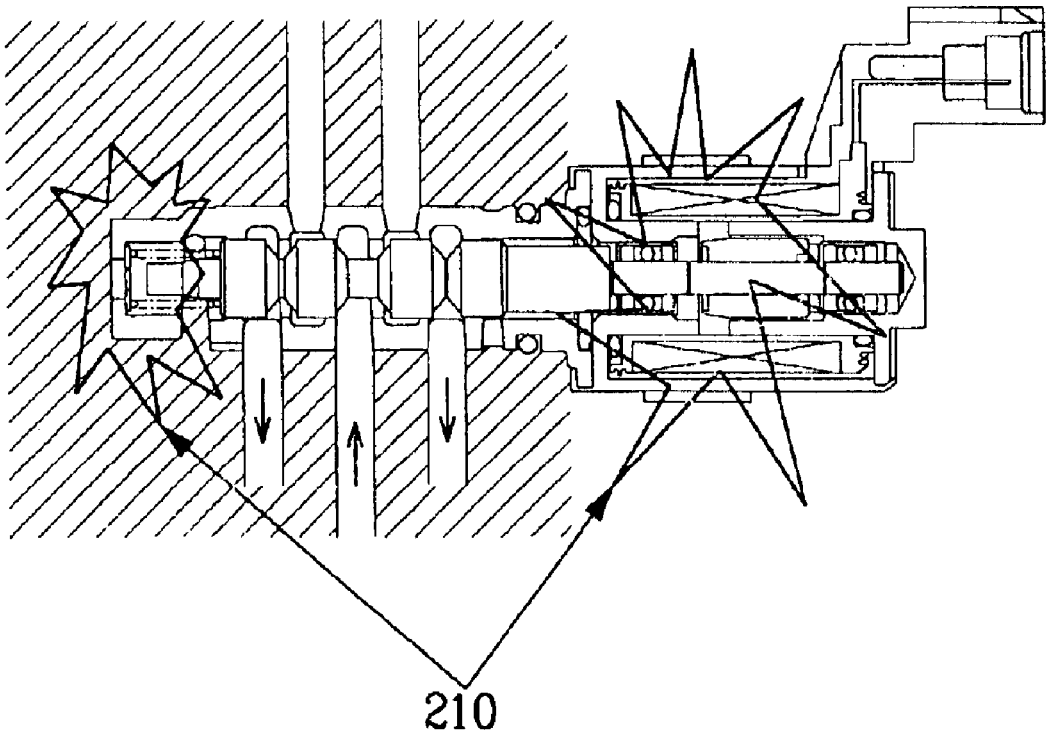
FIG. 2 is a schematic view of an oil controlling driver shown in FIG. 1, showing areas where collision noise is generated.

As shown in FIGS. 1B, 1B and 2, CVVT system includes a valve timing controller 10, an oil controlling driver 20, a camshaft 30, and a vane housing 40. The oil controlling driver 20 includes an advance hole 21 and a retard hole 22 formed in a housing. With this structure, the oil controlling driver 20 controls the supply and exhaust of oil through the advance hole 21 and the retard hole 22 according to valve timing variable control signals received from the valve timing controller 10, to thereby perform valve timing control.

A solenoid valve is used for controlling the flow of oil through the advance hole 21 and the retard hole 22. In use, the oil controlling driver 20 controls displacement of a spool 26 to force oil through either the advance hole 21 or retard hole 22.

The oil controlling driver 20 further includes a supply hole 23 through which oil enters the oil controlling driver 20 from an oil pump 50 after being filtered through an oil filter 52. Exhaust holes 24 and 25 are formed on opposite sides of the supply hole 23 to return oil circulating through the advance hole 21 and the retard hole 22 to an oil storage unit 54.

The camshaft 30 is mounted on a cylinder head and includes an advance oil hole 31(A) and a retard oil hole 32(A) connected respectively to an advance passageway 31(B) and a retard passageway 32(B) formed in the cylinder head. The advance oil hole 31(A) is coupled to the advance hole 21, while the retard oil hole 32(A) is coupled to the retard hole 22. The vane housing 40 includes an advance chamber 41 and a retard chamber 42, which are connected respectively to the advance oil hole 31 and the retard oil hole 32 of the camshaft 30.

Drive resistance of the camshaft 30 may be overcome by pressure formed by oil supplied to chambers on both sides of a vane to effect relative movement between the vane and the vane housing 40. Such movement is controlled to realize optimal valve timing as drive states vary. Further, to realize continuously variable valve timing, the spool 26 is displaced along its longitudinal axis within the housing of the oil controlling driver 20 to control the flow of oil to the vane housing 40. The spool 26 moves only a small amount to maintain the designated hydraulic pressure.

Figure 3A:
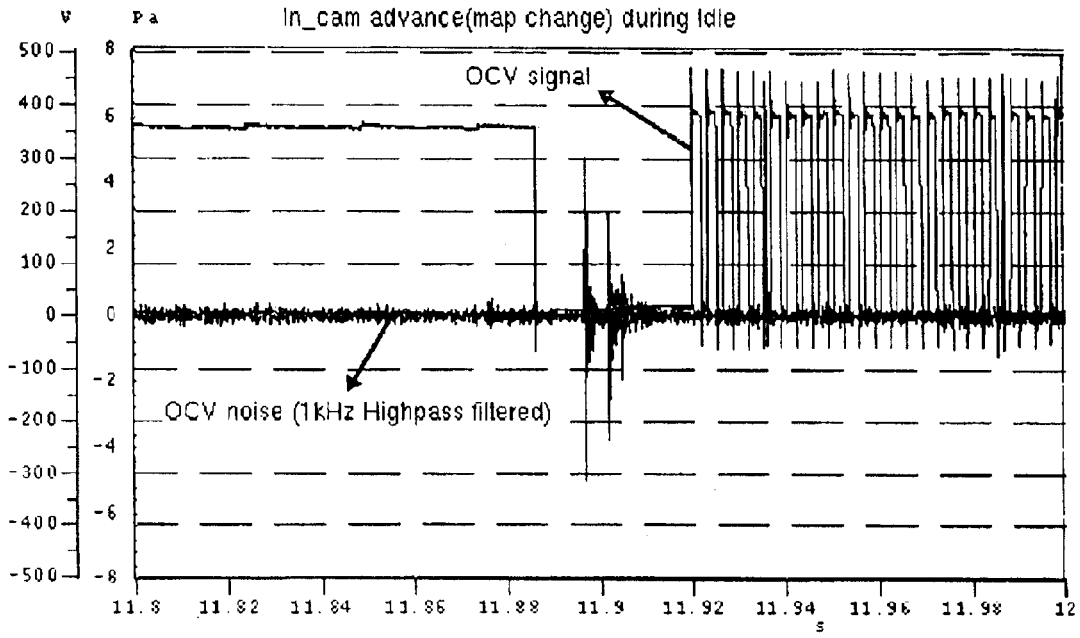
FIGS. 3*a* and 3*b* are graphs showing the relationship between a control signal of an oil controlling driver of FIG. 1 and collision noise generated during operation of an oil controlling driver.
Figure 3B:
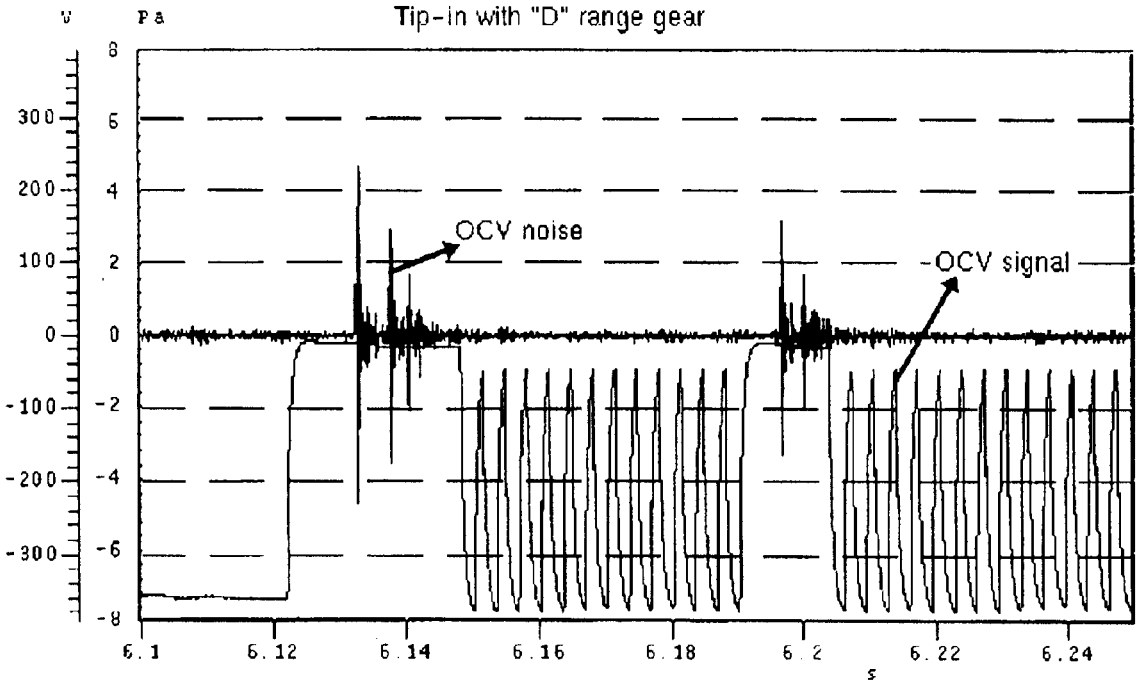

However, when changing the flow of oil the spool 26 of the oil controlling driver 20 typically strikes an inner wall of the housing. This impact generates a high-pitched sound or noise, which is illustrated in FIG. 2 in which reference numeral 210 indicates areas where such sound is generated. FIGS. 3*a* and 3*b* are graphs illustrating the relationship between the control signal of the oil controlling driver 20 and impact sound generated by the collision of the spool 26 with the housing of the oil controlling driver 20, as described above, where "V" is the voltage indicative of the ECU signal for monitoring the oil control valve (OCV) action; "Pa" is pressure in Pascals indicative of noise level; and "s" is time in seconds.

FIGS. 3A and 3B show the occurrence of OCV acting noise when the CVVT angle changes. If there is a difference, the difference results from engine operation conditions. Looking at FIG. 3A, the CVVT angle is intentionally changed by changing the map of ECU during "N" range idle condition. In FIG. 3B, the engine throttle valve is changed rapidly to give rise to a change of CVVT angle during "D" range idle conditions, as would occur when starting the engine. In both cases (FIGS. 3A and 3B) OCV impact against the OCV housing and an impact noise is generated.

Further, if the oil controlling driver 20 operates in a cleaning mode when the engine is started, the spool 26 in the housing of the oil controlling driver 20 is maximally displaced in both directions (at an extremely high speed) to remove metal particles accumulated in the oil controlling driver 20. This in turn generates an extremely loud impact sound.

Figure 4:
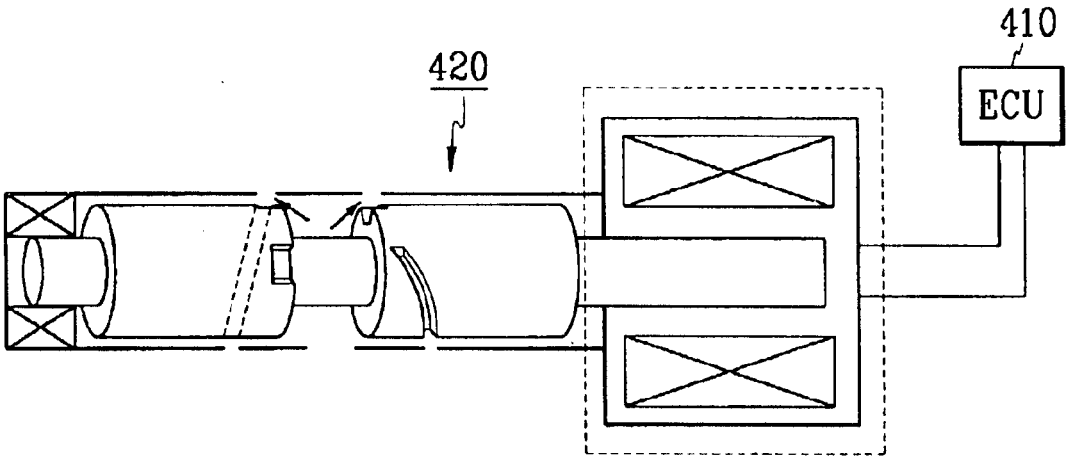
FIG. 4 is a schematic view of a line control apparatus according to a preferred embodiment of the present invention.
Figure 5:
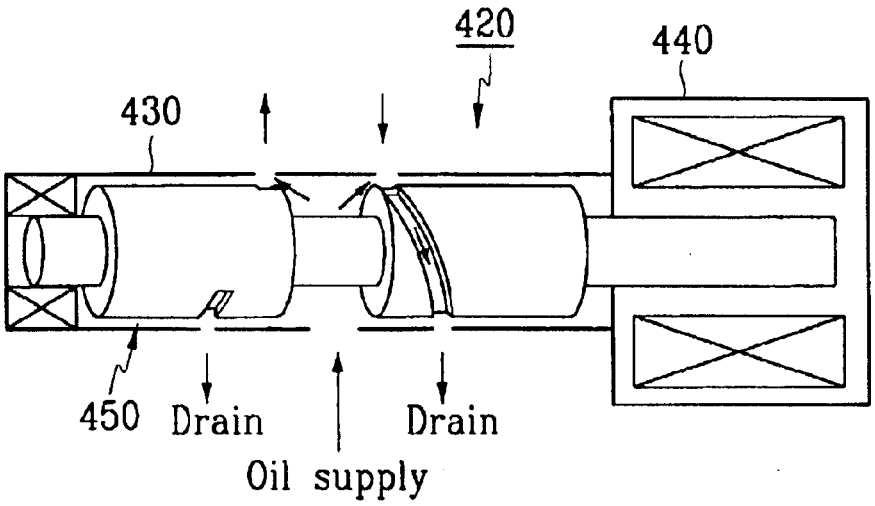
FIG. 5 is a schematic view of an oil controlling driver of FIG. 4.

Therefore, to address these undesirable sounds, a preferred embodiment of the invention, as shown in FIGS. 4 and 5, includes an oil controlling driver 420 that controls fluid flow based on signals received, to operate a continuously variable valve timing (CVVT) system. The present invention also preferably includes a variable valve timing system having an oil controlling driver 420. In particular, the preferred embodiment of the present invention relates to a line control apparatus for a CVVT system, in which a rotating member 450 (FIG. 5) is included in the oil controlling driver 420. The rotating member 450 is operated to move in a predetermined rotational direction to vary fluid flow between advance lines and retard lines. Accordingly, in addition to the components described below, the preferred embodiment of the invention includes all the elements and components described in relation to FIG. 1, except for the valve timing controller 10 and the oil controlling driver 20.

With reference first to FIG. 4, the line control apparatus for a CVVT system, according to a preferred embodiment of the present invention includes a valve timing controller 410 (preferably forming part of an electronic control unit (ECU)) and the oil controlling driver 420. The valve timing controller 410 controls the operations of the line control apparatus of the present invention. In particular, the valve timing controller 410 generates predetermined valve timing variable control signals according to an engine speed.

The valve timing controller 410 preferably uses a microprocessor to analyze signals input by a sensor (not shown) that detects engine speed. The valve timing controller 410 generates a valve timing variable control signal to advance a phase angle of a camshaft when the engine is operating at a high speed. If, on the other hand, the engine is operating at a low speed, the valve timing controller 410 generates a valve timing variable control signal to retard the phase angle of the camshaft. The oil controlling driver 420 is preferably a solenoid-type oil control valve, which generates a rotational force in a predetermined direction according to the valve timing control signal input from the valve timing controller 410.

As shown in FIG. 5, the oil controlling driver 420 includes a housing 430, a motor 440, and the rotating member 450. The housing 430 is cylindrical and includes a plurality of oil passage holes used to selectively couple an oil supply to oil holes and retard oil holes formed in the housing 430 which in turn couple to the advanced oil hole 31(A) and retard oil hole 32(A) via an advance line and retard line, respectively. Further, the housing 430 is formed such that oil flows only when a retard drive oil chamber 472 (FIG. 7) and an advance drive oil chamber 482 (FIG. 7) are aligned with the oil passage holes of the housing 430. This alignment occurs by rotating the rotating member 450 provided within the housing 430. Other areas of the housing 430 (i.e., an inner surface thereof) are in close contact with the rotating member 450 to prevent the free flow of oil between the housing 430 and the rotating member 450 at these locations.

Figure 6:
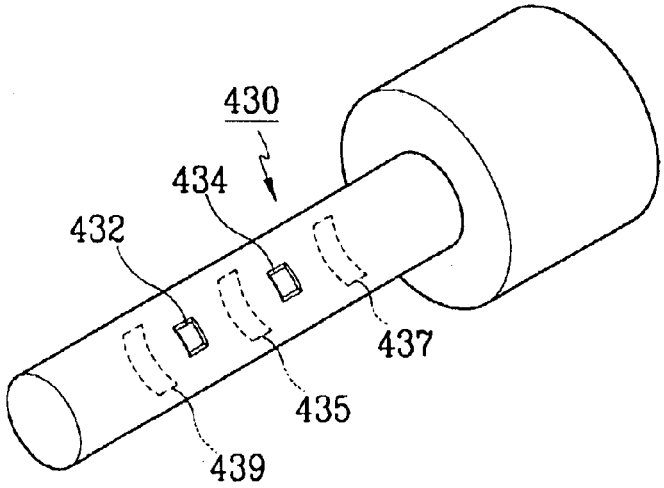
FIG. 6 is a schematic view of a housing of an oil controlling driver of FIG. 4 showing locations of oil passage holes formed in the housing.

With reference to FIG. 6, the plurality of oil passage holes formed in the housing 430 include: an advance hole 432, a retard hole 434, a supply hole 435, and exhaust holes 437 and 439. The advance hole 432 passes through the housing 430 and is connected to an advance oil hole 31(A) (FIG. 1) formed in the CVVT system. The retard hole 434 passes through the housing 430 at a predetermined distance from the advance hole 432, and is connected to a retard hole 32(A) (FIG. 1) formed in the CVVT system. If imaginary straight lines are drawn along a length of an outer circumference of the housing 430, centers of the advance hole 432 and the retard hole 434 lie substantially along the same line, i.e., are aligned with one another along a line substantially parallel to the housing's longitudinal axis.

The supply hole 435 is formed through the housing 430 on a side of the housing substantially opposite to the advance hole 432 and the retard hole 434. Oil from an oil pump is supplied through the supply hole 435. The exhaust holes 437 and 439 are formed through the housing 430 on the same side as the supply hole 435. Centers of the exhaust holes 437 and 439 preferably align with a center of the supply hole 435, with the supply hole 435 being formed between the exhaust holes 437 and 439. The exhaust holes 437 and 439 are more precisely referred to as the advance exhaust hole 437 and the retard exhaust hole 439, respectively. Oil that is circulated through the advance hole 432 and the retard hole 434 are returned to an oil storage unit 54 (FIG. 1) through the advance exhaust hole 437 and the retard exhaust hole 439, respectively.

The motor 440 (FIG. 5) is preferably mounted within the housing 430 to one side of the housing. The motor generates a rotational force in a predetermined direction according to the valve timing variable control signal input from the valve timing controller 410 (FIG. 4). The rotating member 450 is mounted within the housing 430 and is driven by the rotational force generated by the motor 440 to rotate in the predetermined direction, thereby coupling advance and retard lines to the oil supply. As a result, the supply of oil through the advance hole 432 and the retard hole 434, and the exhaust of oil, are varied.

Figure 7:
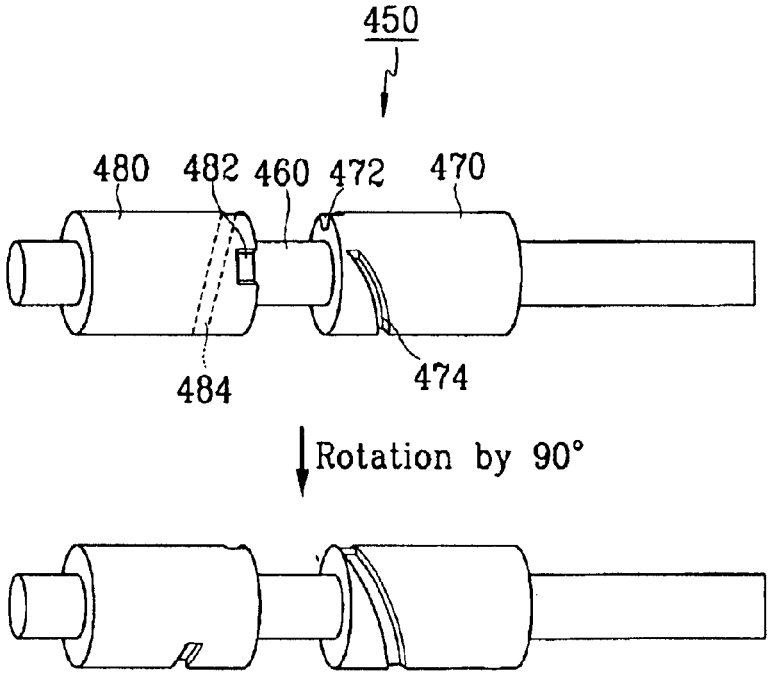
FIG. 7 is a schematic view of a rotating member of FIG. 4, in which two views of opposite sides of the rotating member are shown.

With reference to FIG. 7, the rotating member 450 includes an oil supply rotating shaft 460, a retard body section 470, and an advance body section 480. The oil supply rotating shaft 460 is preferably cylindrical and is rotated by the motor 440. The retard body section 470 is fixedly mounted to a predetermined position on the oil supply rotating shaft 460. An outer circumference of the retard body section 470 comes into close contact with the inner surface of the housing 430. Rotation of the rotating member 450 during retard control is such that the retard body section 470 forms a retard drive fluid flow circuit with the housing 430. The retard body section 470 includes a retard drive oil chamber 472, which, during retard control, stores oil supplied through the supply hole 435 and exhausts oil stored through the retard hole 434. The retard hole 434 is connected to the retard line. The retard body section 470 also includes an advance drain oil chamber 474, which, when the rotating member 450 is rotated during advance control, creates an advanced drain channel defined by the outer circumference of the retard body section 470 and the housing 430, such that ends of the advance drain oil chamber 474 fluidly couple the retard hole 434 to the advance exhaust hole 437.

The advance body section 480 is fixedly mounted to the oil supply rotating shaft 460 at a predetermined distance from the retard body section 470. An outer circumference of the advance body section 480 comes into close contact with the inner surface of the housing 430. Rotation of the rotating member 450 during advance control is such that the advance body section 480 forms an advance drive fluid flow circuit with the housing 430. The advance body section 480 includes an advance drive oil chamber 482, which, during advance control, stores oil supplied through the supply hole 435, and exhausts oil stored through the advance hole 432, that is connected to the advance line. The advance body section 480 also includes a retard drain oil chamber 484, which when the rotating member 450 is rotated during retard control, creates a retard drain channel defined by the advance body section 480 and the housing 430, such that ends of the retard drain oil chamber 484 fluidly couple the advance hole 432 to the retard exhaust hole 439. Accordingly, the formation of the advance line and of the retard line are created by the rotation of the rotating member 450. The advance line is formed through the advance hole 432 of the housing 430, an advance channel of a advance body section 480, an advance oil hole 31(A) (FIG. 1) of the camshaft, and an advance chamber 41 (FIG. 1) of a vane housing 40 (FIG. 1). The retard line is formed through the retard hole 434 of the housing 430, a retard passageway of the retard body section 470, a retard oil hole 32(A) (FIG. 1) of the camshaft, and a retard chamber 42 (FIG. 1) of the vane housing.

When the advance line is formed, the oil passed through the retard drain oil chamber 484 flows into the oil storage unit. On the other hand, when the retard line is formed, the oil passed through the advance drain oil chamber 474 flows into the oil storage unit.

Figure 8A:
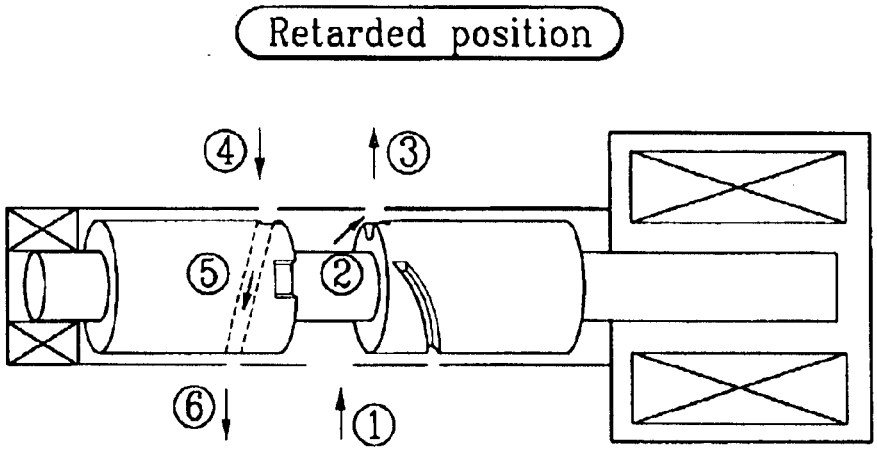
FIGS. 8*a* and 8*b* show the line control apparatus of FIG. 4 in states of retard control and advance control, respectively.

With reference to FIG. 8*a*, as described above, the valve timing controller 410 analyzes signals input by a sensor that detects the engine speed, and generates a valve timing variable control signal to retard the phase angle of the camshaft when the engine is operating at a low speed. If a predetermined valve timing variable control signal (a retard control signal) is supplied to the oil controlling driver 420 from the valve timing controller 410, the rotating member 450 is rotated in a retard direction and oil supplied from the oil pump to the supply hole 435 of the housing 430 exits the oil controlling driver 420 through the retard hole 434 via the retard drive oil chamber 472 (see 1, 2, and 3 in FIG. 8*a*).

Next, the oil passes through the retard passageway connected to the retard hole 434 and through the retard oil hole of the camshaft for supply to the retard chamber of the vane housing, and the camshaft rotates in the retard direction. Reference numerals 4, 5, and 6 in FIG. 8*a* refer to the path flowing to the oil storage unit through the retard drain oil chamber 484.

Figure 8B:
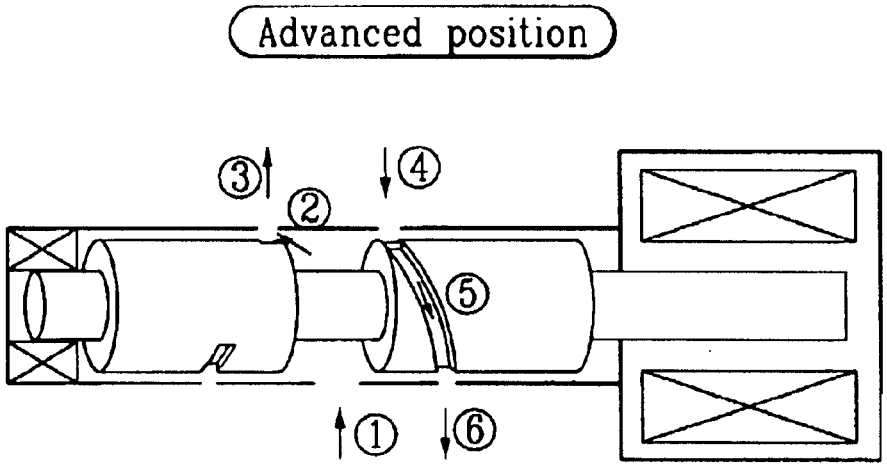

During advance control, with reference to FIG. 8*b*, the valve timing controller 410 analyzes signals input by a sensor that detects the engine speed, and generates a valve timing variable control signal to advance the phase angle of the camshaft when the engine is operating at a high speed. If a predetermined valve timing variable control signal (an advance control signal) is supplied to the oil controlling driver 420 from the valve timing controller 410, the rotating member 450 is rotated in an advance direction. Oil supplied from the oil pump is then supplied to the supply hole 435 of the housing 430, after which the oil exits the oil controlling driver 420 through the advance hole 432 via the advance drive oil chamber 482 (see 1, 2, and 3 in FIG. 8*b*).

Next, the oil passes through the advance passageway of the cylinder head connected to the advance hole 432 and through the advance oil hole of the camshaft for supply to the advance chamber of the vane housing, and the camshaft rotates in the advance direction. Reference numerals 4, 5, and 6 in FIG. 8*b* refer to the path flowing to the oil storage unit through the advance drain oil chamber 474.

In the line control arrangement for a CVVT system according to a preferred embodiment of the present invention described above, the rotating member 450 of the oil controlling-driver 420 is rotated depending on engine speed such that oil is supplied through an advance line or a retard line. As a result, noise is not generated by the oil controlling driver 420 as in conventional systems. That is, the spool in conventional systems creates noise when it strikes the inside of the oil controlling driver 420 when undergoing rectilinear motion to vary lines. The line control arrangement of the present invention overcomes this problem by forming the advance and retard lines with a rotating rather than linear reciprocating element.

Although a preferred embodiment of the present invention has been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A line control arrangement for a continuously variable valve timing system of a vehicle, comprising:

a valve timing controller generating a predetermined valve timing variable control signal according to an engine speed of the vehicle; and an oil controlling driver generating a rotational force in a predetermined direction according to the valve timing variable control signal received from the valve timing controller to form a corresponding advance line and a corresponding retard line, wherein the oil controlling driver comprises a housing including a plurality of oil passage holes, a motor mounted within the housing to one side of the housing, the motor generating the rotational force in a predetermined direction according to the valve timing variable control signal supplied from the valve timing controller.

a rotating member mounted within the housing and rotating by the rotational force of the motor to vary the flow of oil passing through the oil passage holes, wherein the rotating member comprises an oil supply rotating shaft receiving the rotational force of the motor, the rotating shaft being cylindrically formed, a retard body section fixedly mounted to a predetermined position of the oil supply rotating shaft such that an outer circumference of the retard body section comes into close contact with an inner surface of the housing, rotation of the rotating member during retard control being such that the retard body section forms a retard drive circuit with the housing, and an advance body section fixedly mounted to the oil supply rotating shaft at a predetermined distance from the retard body section such that an outer circumference of the advance body section comes into close contact with the inner surface of the housing, rotation of the rotating member during advance control being such that the advance body section forms an advance drive circuit with the housing, wherein said advance body section defines a retard drain oil chamber configured and dimensioned at least partially circumferencially around said advance body with a predetermined inclination, and wherein said retard body section defines an advance drain oil chamber configured and dimensioned at least partially circumferencially around said retard body section with a predetermined inclination.

2. The line control arrangement of claim 1, wherein the oil passage holes comprise:

an advance hole formed through a circumference of the housing;

a retard hole formed through the circumference of the housing at a predetermined distance from the advance hole;

a supply hole formed between the advance hole and the retard hole, oil supplied from an oil pump being supplied through the supply hole;

a first exhaust hole exhausting oil returned to the housing through the advance hole; and a second exhaust hole exhausting oil returned to the housing through the retard hole.

3. The line control arrangement of claim 1, wherein the retard body section comprises:

a retard drive oil chamber, which, during retard control, stores oil supplied through a supply hole and exhausts oil stored through a retard hole which is formed through a circumference of the housing and connected to the retard line; and said advance drain oil chamber, which, when the rotating member is rotated during advance control, is formed maintaining a predetermined angle following an outer circumference of the retard body section and in a slanting direction such that ends of the advance drain oil chamber are connected to each of the retard hole and an advance exhaust hole formed through a circumference of the housing.

4. The line control arrangement of claim 1, wherein the advance body section comprises:

an advance drive oil chamber, which, during advance control, stores oil supplied through the supply hole and exhausts oil stored through an advance hole, which is formed through a circumference of the housing and connected to the advance line; and a said retard drain oil chamber, which, when the rotating member is rotated during retard control, is formed maintaining a predetermined angle following an outer circumference of the advance body section and in a slanting direction such that ends of the retard drain oil chamber are connected to each of the advance hole and a retard exhaust hole formed through a circumference of the housing.

5. A line control arrangement for a continuously variable valve timing system of a vehicle, comprising:

a housing;

an oil supply shaft rotatably mounted within said housing;

a motor configured to rotate said oil supply shaft to an advance position or a retard position based on a predetermined valve timing variable control signal received from a valve timing controller;

an advance passageway formed through said housing when said oil supply shaft is in said advance position, said advance passageway fluidly coupling an oil supply hole to an advance hole, wherein said advance passageway comprises a passageway defined by an advance body section coupled to said oil supply shaft, and said housing, and wherein said advance body section further defines a retard drain oil chamber, said retard drain oil chamber configured and dimensioned at least partially circumferencially around said advance body section at a predetermined inclination; and a retard passageway formed through said housing when said oil supply shaft is in said retard position, said retard passageway fluidly coupling an oil supply hole and a retard hole, wherein said retard passageway comprises a passageway defined by a retard body section coupled to said oil supply shaft, and said housing, and wherein said retard body section further defines an advance drain oil chamber, said advance drain oil chamber configured and dimensioned at least partially circumferencially around said retard body section at a predetermined inclination.

6. The line control arrangement of claim 5, wherein said supply hole is configured to be fluidly coupled to an oil supply.

7. The line control arrangement of claim 5, wherein said retard hole is configured to be coupled to a retard chamber in a vane housing.

8. The line control arrangement of claim 5, wherein said advance hole is configured to be coupled to an advance chamber in a vane housing.

9. The line control arrangement of claim 5, further comprising an advance drain channel formed when said oil supply shaft is in said retard position, said advanced drain channel fluidly coupling said retard hole to an exhaust hole.

10. The line control arrangement of claim 5, further comprising a retard drain channel formed when said oil supply shaft is in said advance position, said retard drain channel fluidly coupling said advance hole to an exhaust hole.

11. The line control arrangement of claim 5, wherein said advance drain channel comprises a passageway defined by a retard body section coupled to said oil supply shaft, and said housing.

12. The line control arrangement of claim 5, wherein said retard drain channel comprises a passageway defined by an advanced body section coupled to said oil supply shaft, and said housing.

* * * * *